US010533549B1

(12) United States Patent
Bush

(10) Patent No.: US 10,533,549 B1
(45) Date of Patent: Jan. 14, 2020

(54) BILGE PUMP SAFETY SYSTEM

(71) Applicant: Alexander Bush, Baltimore, MD (US)

(72) Inventor: Alexander Bush, Baltimore, MD (US)

( * ) Notice: Subject to any disclaimer, the term of this patent is extended or adjusted under 35 U.S.C. 154(b) by 282 days.

(21) Appl. No.: 15/728,876

(22) Filed: Oct. 10, 2017

(51) Int. Cl.

| | |
|---|---|
| ***F04B 49/10*** | (2006.01) |
| ***F04B 49/06*** | (2006.01) |
| ***F04B 17/03*** | (2006.01) |
| ***F04B 53/00*** | (2006.01) |
| ***G08B 5/22*** | (2006.01) |

(52) U.S. Cl.
CPC ..... *F04B 49/10* (2013.01); *F04B 17/03* (2013.01); *F04B 49/065* (2013.01); *G08B 5/224* (2013.01); *F04B 53/00* (2013.01)

(58) Field of Classification Search
CPC ..... F04B 49/04; F04B 49/025; F04B 39/00; F04B 53/00; F04B 49/06; F04B 49/065; G01F 23/30; G08B 5/222–224
USPC ..... 417/36, 40; 114/183 R
See application file for complete search history.

(56) References Cited

U.S. PATENT DOCUMENTS

| | | | | |
|---|---|---|---|---|
| 1,747,357 | A * | 2/1930 | Frenier | F04B 49/04 417/17 |
| 5,078,577 | A | 1/1992 | Heckman | |
| 6,469,641 | B1 * | 10/2002 | Lash | B60R 25/1003 114/142 |
| 6,473,004 | B1 | 10/2002 | Smull | |
| 7,391,298 | B1 | 6/2008 | Campbell | |
| D601,590 | S | 10/2009 | Burnham | |
| 7,661,380 | B2 | 2/2010 | Waldecker | |
| 8,531,316 | B2 | 9/2013 | Velado | |
| 2002/0118102 | A1 | 8/2002 | Fundak | |

FOREIGN PATENT DOCUMENTS

| | | | | |
|---|---|---|---|---|
| CA | 2706807 | A1 * | 12/2011 | G01F 23/0076 |
| WO | WO-2008029221 | A2 * | 3/2008 | B63B 43/00 |
| WO | 2011056269 | A1 | 5/2011 | |

* cited by examiner

*Primary Examiner* — Philip E Stimpert
(74) *Attorney, Agent, or Firm* — Kyle A. Fletcher, Esq.

(57) ABSTRACT

The bilge pump safety system comprises a bilge pump, a primary switch, a monitor switch, and a control system. The primary switch is a first float switch that controls the operation of the bilge pump based on the level of liquid accumulated in the bilge that is protected by the bilge pump. The monitor switch is a second float switch installed within the bilge such that the monitor switch mimics the operation of the primary switch. By mimic is meant that: 1) when the primary switch is closed the monitor switch is closed; and, 2) when the primary switch is open the monitor switch is open. The control system simultaneously monitors the status of both the primary switch and the monitor switch. In situations where the operation of the monitor switch does not mimic the primary switch, the control system generates a message to an appropriate authority.

18 Claims, 5 Drawing Sheets

BILGE PUMP SAFETY SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of engines and pumps, more specifically, a safety mechanism configured for use in the regulation of a pump.

SUMMARY OF INVENTION

The bilge pump safety system is a configured for use with a bilge pump. The bilge pump safety system comprises a bilge pump, a primary switch, a monitor switch, and a control system. The bilge pump is a readily and commercially available bilge pump. The primary switch is a first float switch that engages and disengages the operation of the bilge pump based on the level of liquid accumulated in the bilge protected by the bilge pump. The monitor switch is a second float switch installed within the bilge such that monitor switch mimics the operation of the primary switch. By mimic is meant that: 1) when the primary switch is closed the monitor switch is closed; and, 2) when the primary switch is open the monitor switch is open. The control system simultaneously monitors the status of both the primary switch and the monitor switch. In situations where the operation of the monitor switch does not mimic the primary switch, the control system generates a message to an appropriate authority.

These together with additional objects, features and advantages of the bilge pump safety system will be readily apparent to those of ordinary skill in the art upon reading the following detailed description of the presently preferred, but nonetheless illustrative, embodiments when taken in conjunction with the accompanying drawings.

In this respect, before explaining the current embodiments of the bilge pump safety system in detail, it is to be understood that the bilge pump safety system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bilge pump safety system.

It is therefore important that the claims be regarded as including such equivalent construction insofar as they do not depart from the spirit and scope of the bilge pump safety system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
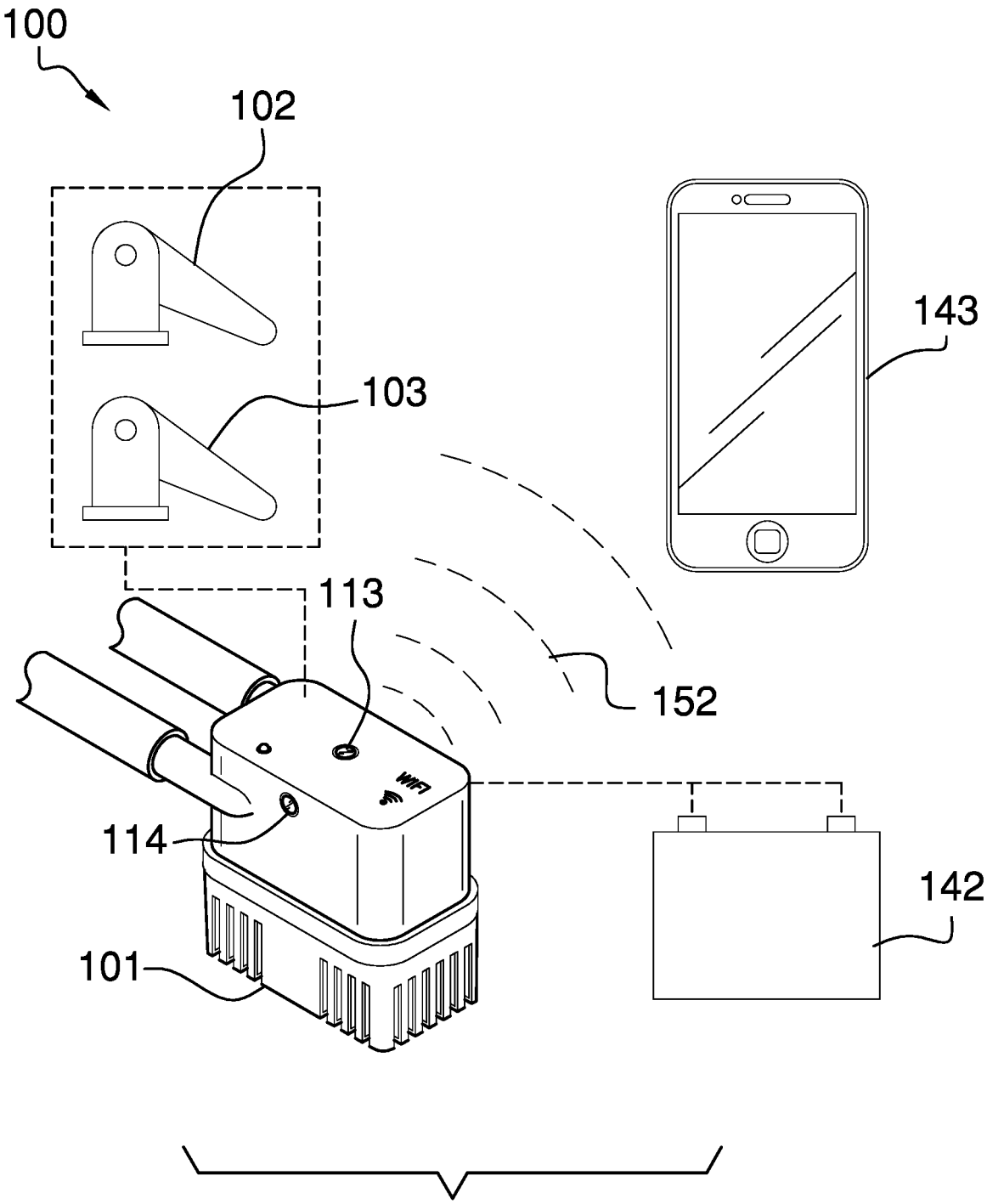
FIG. 1 is a detail view of an embodiment of the disclosure.
Figure 2:
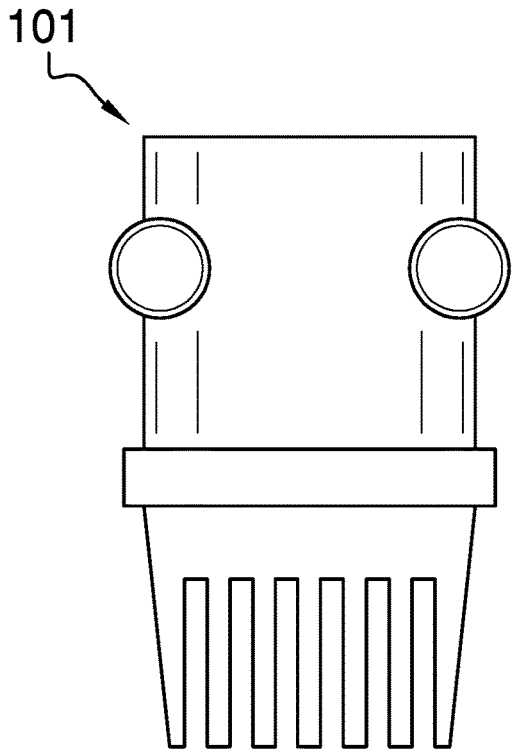
FIG. 2 is a back view of an embodiment of the disclosure.
Figure 3:
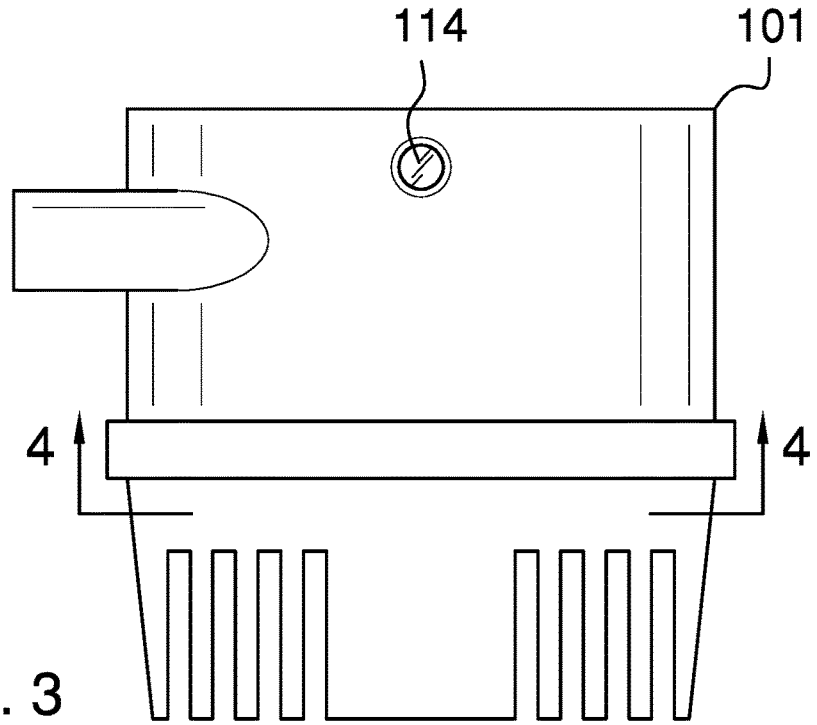
FIG. 3 is a side view of an embodiment of the disclosure.
Figure 4:
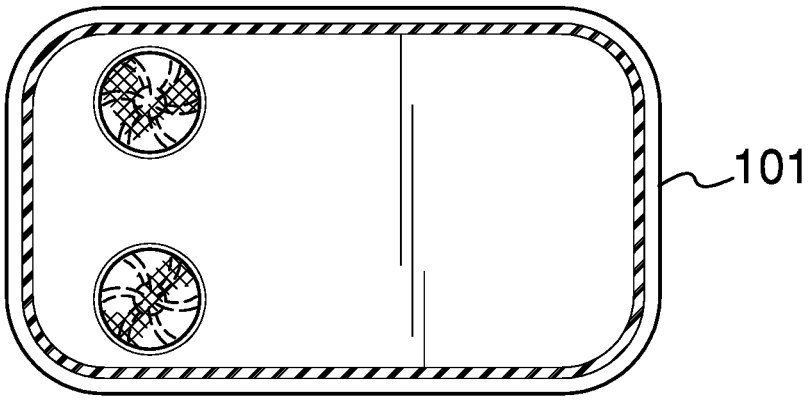
FIG. 4 is a detail view of an embodiment of the disclosure.
Figure 5:
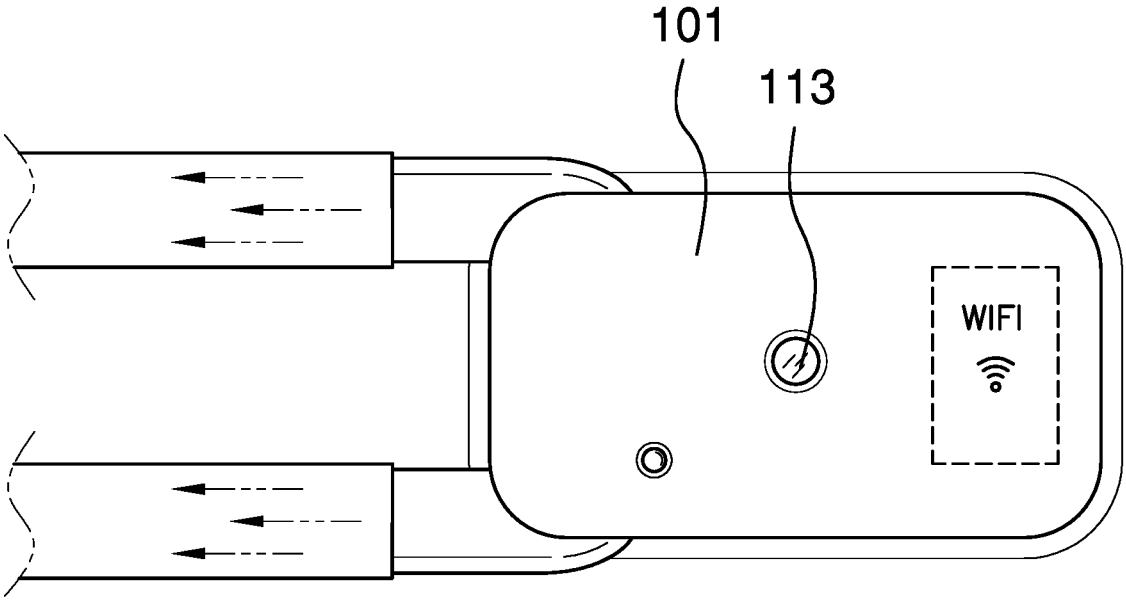
FIG. 5 is an in use view of an embodiment of the disclosure.
Figure 6:
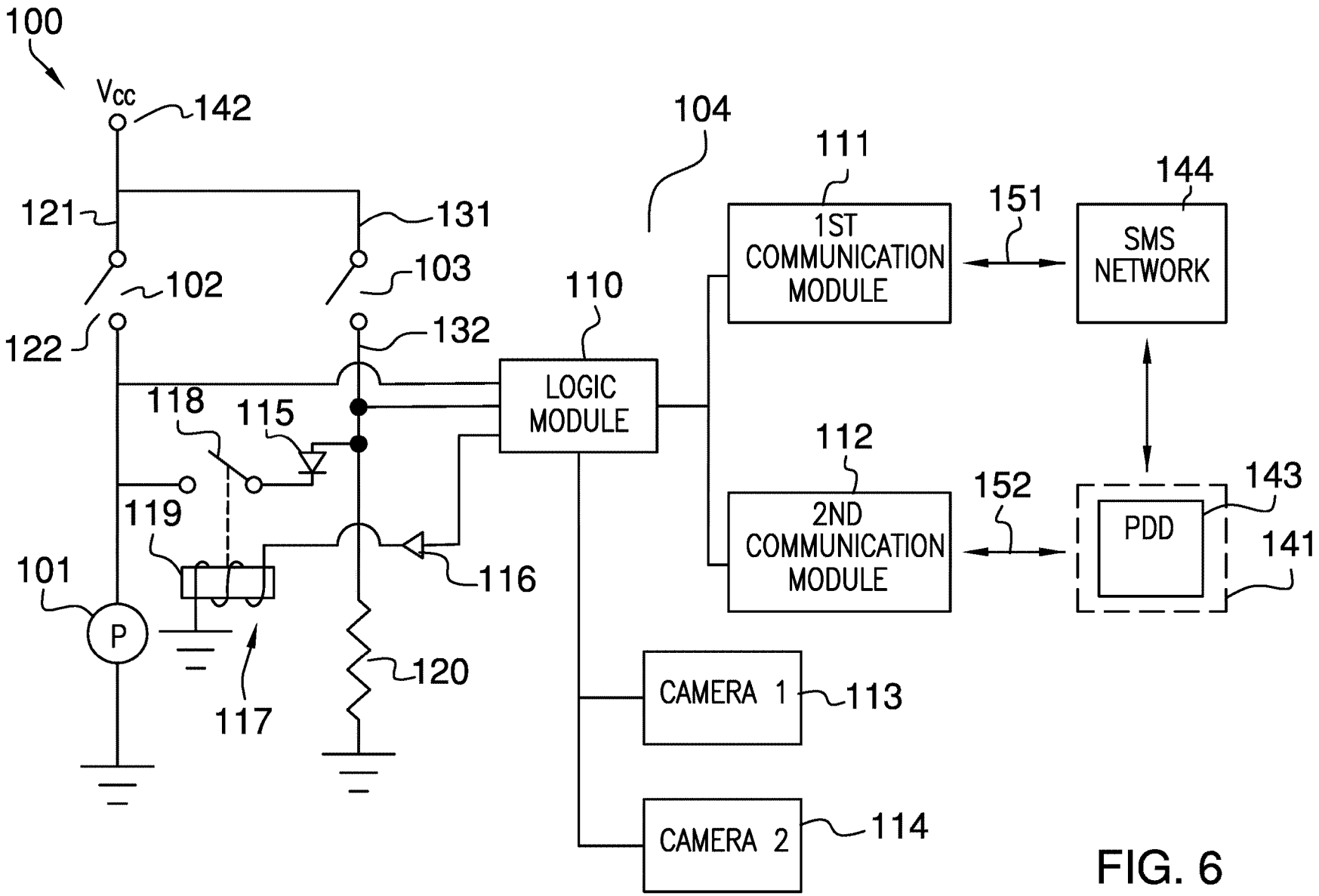
FIG. 6 is a block diagram of an embodiment of the disclosure.
Figure 7:
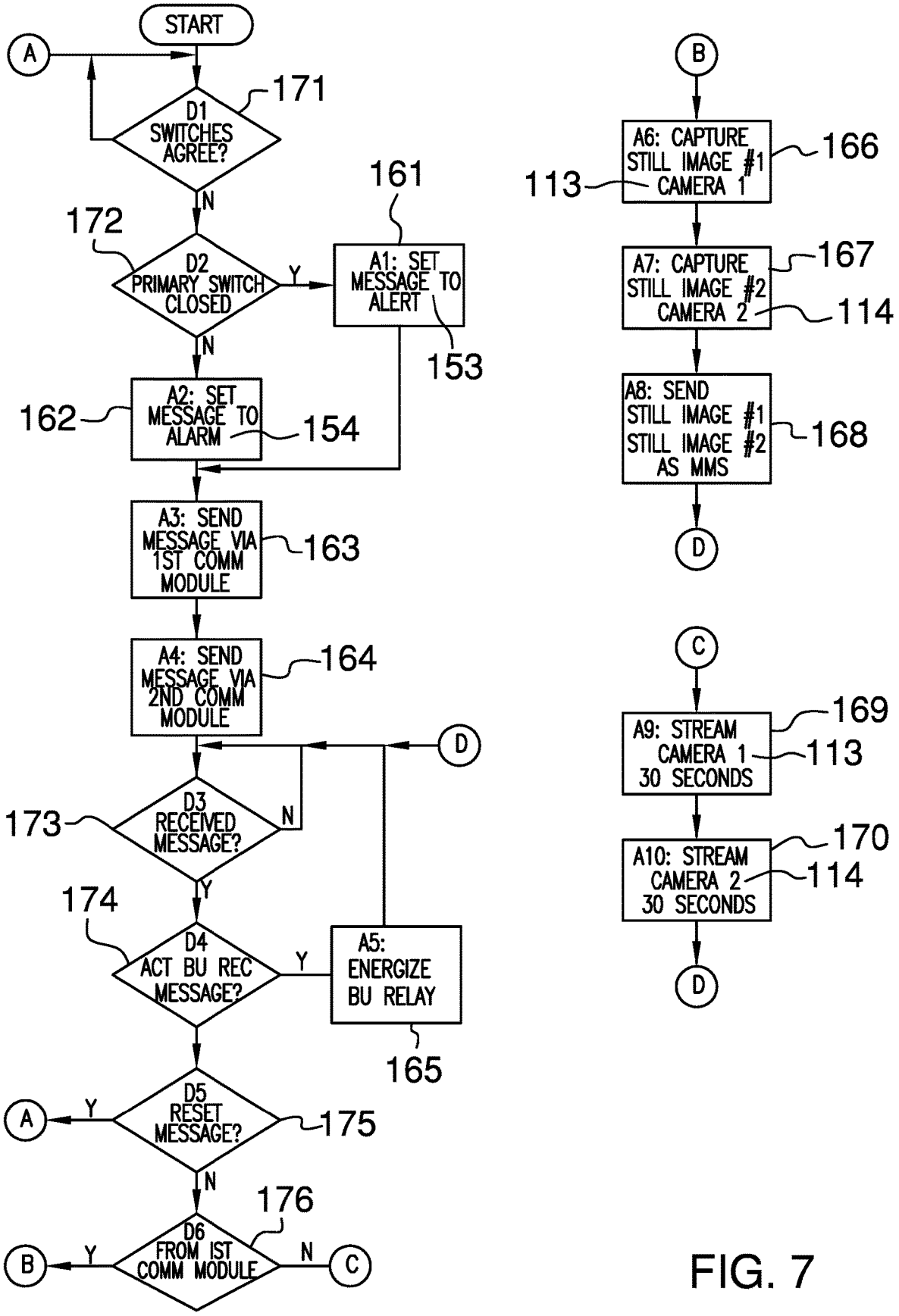
FIG. 7 is a flowchart of an embodiment of the disclosure.

Detailed reference will now be made to one or more potential embodiments of the disclosure, which are illustrated in FIGS. 1 through 7.

The bilge pump safety system 100 (hereinafter invention) is a configured for use with a bilge pump 101. The invention 100 comprises a bilge pump 101, a primary switch 102, a monitor switch 103, and a control system 104. The bilge pump 101 is a readily and commercially available bilge pump 101. The primary switch 102 is a first float switch that engages and disengages the operation of the bilge pump 101 based on the level of liquid accumulated in the bilge that is protected by the bilge pump 101. The monitor switch 103 is a second float switch installed within the bilge such that monitor switch 103 mimics the operation of the primary switch 102. By mimic is meant that: 1) when the primary switch 102 is closed the monitor switch 103 is closed; and, 2) when the primary switch 102 is open the monitor switch 103 is open. The control system 104 simultaneously monitors the status of both the primary switch 102 and the monitor switch 103. In situations where the operation of the monitor switch 103 does not mimic the primary switch 102, the control system 104 generates a message to an appropriate authority 141.

The appropriate authority 141 refers to a person or organization who is authorized to receive messages from the invention 100. An external power source 142 is an externally provided source of electrical energy. In the first potential embodiment of the disclosure, the external power source 142 is the electrical system of the boat. The personal data device 143 is an electronic device maintained by the appropriate authority 141 to receive messages from the invention 100.

The bilge pump 101 is a readily and commercially available bilge pump 101 that removes accumulated liquid from the bilge of a watercraft. The use of a bilge pump 101 is well-known and documented within the transportation arts.

The primary switch 102 is a readily and commercially available float switch. The primary switch 102 monitors the level of accumulated liquid within the bilge. The primary switch 102 directly controls the flow of electrical energy to the bilge pump 101 based on the level of accumulated liquid detected by the primary switch 102. The status of the primary switch 102 is monitored by the control system 104.

The primary switch 102 is further defined with a first primary switch lead 121 and a second primary switch lead 122. The first primary switch lead 121 is the lead of the primary switch 102 that electrically connects to the external power source 142. The second primary switch lead 122 is the lead of the primary switch 102 that electrically connects to the bilge pump 101. The logic module 110 monitors the second primary switch lead 122. The operating assumption of the logic module is that when a voltage appears at the second primary switch lead 122, the second primary switch lead 122 is closed.

The monitor switch 103 is a readily and commercially available float switch. Like the primary switch 102, the monitor switch 103 monitors the level of accumulated liquid within the bilge. The status of the monitor switch 103 is monitored by the control system 104. The control system 104 uses the monitor switch 103 to validate the operation of the primary switch 102. The operating assumption of the invention is that when the monitor switch 103 mimics the operation of the primary switch 102, the invention 100 is operating properly. When the monitor switch 103 fails to mimic the primary switch 102 the operating assumption is that the invention 100 is operating improperly.

The monitor switch 103 is further defined a first monitor switch lead 131 and a second monitor switch lead 132. The first monitor switch lead 131 is the lead of the monitor switch 103 that electrically connects to the external power source 142. The second monitor switch lead 132 is the lead of the monitor switch 103 that electrically connects to a pull-down resistor 120. The logic module 110 monitors the second monitor switch lead 132. The operating assumption of the logic module 110 is that when a voltage appears at the second monitor switch lead 132, the second monitor switch lead 132 is closed.

The primary switch 102 and the monitor switch 103 are installed directly in the bilge pump 101.

The control system 104 is an electric circuit that controls the operation of the invention 100. The control system 104: 1) monitors the status of the primary switch 102; 2) monitors the status of the monitor switch 103; 3) sends a message to an appropriate authority 141 when the operating status of the monitor switch 103 does not mimic the operating status of the primary switch 102; 4) receives and processes messages from the appropriate authority 141; 5) captures images of the bilge and sends the captured images to the appropriate authority 141; and, 6) initiates a backup protocol that provides electrical power to the bilge pump 101 in an emergency.

The control system 104 comprises a logic module 110, a first communication module 111, a second communication module 112, a first camera 113, a second camera 114, a diode 115, an amplifier 116, a relay 117, and a pull-down resistor 120. The relay 117 is further defined a relay switch 118 and a relay coil 119.

The logic module 110 is a readily and commercially available programmable electronic device that is used to manage, regulate, and operate the control system 104. Depending on the specific design and the selected components, the logic module 110 can be a separate component within the in control system 104 or the functions of the logic module 110 can be incorporated into another component within the control system 104.

The first communication module 111 communicates SMS and MMS messages between the logic module 110 and the appropriate authority 141 through a first wireless communication link 151 established with a commercially provided and publicly available cellular wireless network 144. The use of a commercially provided and publicly available cellular wireless network 144 is preferred because: 1) of its low cost; 2) of the widespread availability and the broad interoperability between competing commercially provided and publicly available cellular wireless networks 144; and, 3) methods and techniques to send SMS and MMS messages over a commercially provided and publicly available cellular wireless network 144 are well known and documented by those skilled in the electrical arts. The commercially provided and publicly available cellular wireless network 144 is a commercially available communication service often referred to as the cellular network.

The second communication module 112 is a wireless electronic communication device that allows the logic module 110 to wirelessly communicate with a locally presented device such as a personal data device 143. Specifically, the second communication module 112 establishes a second wireless communication link 152 between the control system 104 and the personal data device 143 or other locally presented device monitored by the appropriate authority 141. In the first potential embodiment of the disclosure, the second communication module 112 supports a communication protocol selected from the group consisting of a WiFi protocol or a Bluetooth protocol.

The first camera 113 is a readily and commercially available image sensor. The first camera 113 captures images of the area surrounding the bilge pump 101. The first camera 113 transfers all captured images as electrical signals to the logic module 110, which encodes the received electrical signals and sends the encoded image file to the appropriate authority 141.

The second camera 114 is a readily and commercially available image sensor. The second camera 114 captures images of the area surrounding the bilge pump 101. The second camera transfers all captured images as electrical signals to the logic module 110, which encodes the received electrical signals and sends the encoded image file to the appropriate authority 141.

The field of view of the second camera 114 is perpendicular to the field of view of the first camera 113. The first camera 113 and the second camera 114 are installed directly in the bilge pump 101. Both the first camera 113 and the second camera 114 are capable of capturing still images and video images. Methods to install and operate the first camera 113 and the second camera 114 are well-known and documented in the electrical arts.

The relay 117 is an electromechanical switching device that is controlled by the logic module 110. The relay 117 transfers electrical power from the monitor switch 103 to the bilge pump 101 in cases where the primary switch 102 has failed. The relay switch 118 is the switch contained and operated within the relay 117. The relay switch 118 makes a physical electrical connection transfers electrical power from the monitor switch 103 to the bilge pump 101. The relay coil 119 is an electromagnetic device. The relay coil 119 opens and closes the relay switch 118. The relay coil 119 receives control signals from the logic module 110 through the amplifier 116.

The amplifier 116 is a commercially available electrical device that: 1) amplifies the control signal generated by the logic module 110 which drives the relay coil 119; and, 2) electrically buffers the logic module 110 from voltage spikes generated by the relay coil 119.

The diode 115 is an electrical device that allows the flow of electric current in only one direction. The diode 115 isolates the bilge pump 101 from the control system 104.

The operation of the control system 104 is described in the following ten paragraphs.

The logic module 110 makes a first decision 171 to determine if the monitor switch 103 mimics the primary switch 102. The logic module 110 does this by comparing the voltage at the second monitor switch lead 132 with the voltage at the second primary switch lead 122. If the logic module 110 detects a voltage at both the second monitor switch lead 132 and the second primary switch lead 122, the operating assumption is that the monitor switch 103 mimics the primary switch 102 and the logic module 110 loops back to the first decision 171.

If the monitor switch 103 does not mimic the primary switch 102, the logic module 110 makes a second decision 172 to determine if the primary switch 102 is closed. The operating assumption of the logic module 110 is that if a voltage is detected at the second primary switch lead 122, then the primary switch 102 is closed.

If the primary switch 102 is closed, the logic module 110 takes a first action 161 of setting a previously worded alert message 153 to be the message sent to the appropriate authority 141. The alert message 153 is a previously composed message that informs the appropriate authority 141 that: 1) a fault has been detected in the invention 100; and, 2) the bilge pump 101 can draw power from the external power source 142.

If the primary switch 102 is open the logic module 110 takes a second action 162 of setting a previously worded alarm message 154 to be the message sent to the appropriate authority 141. The alarm message 154 is a previously composed message that informs the appropriate authority 141 that: 1) a fault has been detected in the invention 100; and, 2) the bilge pump 101 is not able to draw power from the external power source 142.

The logic module 110 takes a third action 163 of sending the selected message as an SMS message through the first communication module 111 and the commercially provided and publicly available cellular wireless network 144 to the personal data device 143 of the appropriate authority 141. The logic module 110 takes a fourth action 164 using the second communication module 112 to send the selected message directly to the personal data device 143 of the appropriate authority 141 using the second wireless communication link 152.

The logic module 110 makes a third decision 173 to determine if the appropriate authority 141 has sent a message to a module selected from the group consisting of the first communication module 111 and the second communication module 112. If such a message has not been received, the logic module 110 loops back to the third decision 173. If such a message has been received, the logic module 110 takes a fourth decision 174 to determine if the received message calls for activating the relay 117. If the received message calls for activating the relay 117, the logic module 110 takes a fifth action 165 of sending a control signal to the relay coil 119 through the amplifier 116 to energize the relay 117.

When the relay 117 is energized, the relay switch 118 transfers electrical energy from the external power source 142 through the monitor switch 103 directly to the bilge pump 101. The logic module 110 then loops back to the fourth decision 174.

Otherwise, the logic module 110 makes a fifth decision 175 to determine if a reset has been requested. If a reset has been requested, the logic module 110 immediately loops back to the first decision 171. If a reset has been not requested, the logic module 110 takes a sixth decision 176 to determine whether the first communication module 111 received the message.

If the first communication module 111 received the message, the logic module 110 takes a sixth action 166 of capturing a first image from the first camera 113. The logic module 110 next takes a seventh action 167 of capturing a second image from the second camera 114. The logic module 110 next takes an eighth action 168 of sending the first image and the second image as MMS messages to the appropriate authority 141 through the first communication module 111. The logic module 110 then loops back to the fourth decision 174.

If the first communication module 111 did not receive the message, the logic module 110 takes a ninth action 169 of capturing 30 seconds of video from first camera 113 and streaming the captured video to the appropriate authority 141 using the second communication module 112. The logic module 110 then takes a tenth action 170 of capturing 30 seconds of video from second camera 114 and streaming the captured video to the appropriate authority 141 using the second communication module 112. The logic module 110 then loops back to the fourth decision 174.

The following definitions were used in this disclosure:

Amplifier: As used in this disclosure, an amplifier refers to an electronic component that increases voltage, current, or power of an input signal. Specifically, within this disclosure, an amplifier refers to a differential amplifier. A differential amplifier is a device two input electrical device with a single output. A difference amplifier amplifies the voltage difference between the two inputs.

Appropriate Authority: As used in this disclosure, an appropriate authority is a previously determined person or organization that is designated to receive an alarm or other notification messages regarding a monitored system or activity.

Battery: As used in this disclosure, a battery is a chemical device consisting of one or more cells, in which chemical energy is converted into electricity and used as a source of power.

Bluetooth: As used in this disclosure, Bluetooth is a standardized communication protocol that wirelessly interconnects electronic devices.

Camera: As used in this disclosure, a camera is a sensor that converts light into electric signals that encode and records the spatial orientation of the captured light in a manner that reproduces the images seen by a human eye.

Control System: As used in this disclosure, a control system is a first device or system that manages and regulates the behavior or operation of a second device or system.

Diode: As used in this disclosure, a diode is a two terminal semiconductor device that allows current flow in only one direction. The two terminals are called the anode and the cathode. Electric current is allowed to pass from the anode to the cathode.

Electromagnet: As used in this disclosure, an electromagnet is a core formed from a magnetic material that has a coil formed from an electric current carrying conductor wrapped around it. When an electric current flows through the coil, The core exhibits magnetic properties when an electric current flows through the coil and exhibits no (or reduced) magnetic properties when an electric current is not flowing through the coil.

External Power Source: As used in this disclosure, an external power source is a source of the energy that is externally provided to enable the operation of the present disclosure. Examples of external power sources include, but are not limited to, electrical power sources and compressed air sources.

Field of View: As used in this disclosure, a field of view refers to one or more angles which delimits an area from which electromagnetic radiation will be sensed by a person or an image sensor.

Float Switch: As used in this disclosure, a float switch is a commercially available switch that is actuated by the level of liquid contained within a contained space. A common use of a float switch is in the operation of a bilge or sump pump. Specifically, when the level of accumulated liquid in a bilge or a sump exceeds a predetermined level, the float switch will actuate into a closed position that completes an electric circuit that provides electrical power to a pump that will remove the liquid from the bilge or sump. When the accumulated liquid falls below the predetermined level, the float switch will actuate into an open position discontinuing the operation of the pump.

Image: As used in this disclosure, an image is an optical representation or reproduction of an indicia or an appearance of something or someone.

Image Sensor: As used in this disclosure, an image sensor receives light from the exterior of the image sensor and converts the received light into a digital representation of sufficient detail to allow a logic module to create and display a visual reproduction of the source of the captured light.

Lead: As used in this disclosure, a lead is a conductor that is physically used to electrically connect an electrical component into a larger circuit assembly.

Logic Module: As used in this disclosure, a logic module is a readily and commercially available electrical device that is programmable and that accepts digital and analog inputs, processes the digital and analog inputs according to previously stored instruction and provides the results of these instructions as digital or analog outputs.

PDD: As used in this disclosure, PDD is an acronym for a personal data device.

Personal Data Device: As used in this disclosure, a personal data device is a handheld device that manages personal information and communication. Examples of personal data device include, but are not limited to, cellular phones, tablets, and smart phones.

Pull-Down Resistor: As used in this disclosure, a pull-down resistor is an electrical resistor that is used within a switching or logic circuit to present a predetermined signal voltage to an externally provided logic circuit.

Pump: As used in this disclosure, a pump is a mechanical device that uses suction or pressure to raise or move fluids, compress fluids, or force a fluid into an inflatable object. Within this disclosure, a compressor refers to a pump dedicated to compressing a fluid or placing a fluid under pressure.

Relay: As used in this disclosure, a relay is an automatic electromagnetic or electromechanical device that reacts to changes in voltage or current by opening or closing a switch in an electric circuit. Relays are further defined with a coil and a switch. Applying a voltage to the coil, usually referred to as energizing the coil, will cause the coil to change the position of the switch.

Resistor: As used in this disclosure, a resistor is a well-known and commonly available electrical device that inhibits the flow of electricity through an electric circuit. Within an electric circuit processing alternating currents, the resistor will not affect the phase of the alternating current. A current flowing through a resistor will create a voltage across the terminals of the resistor.

SMS: As used in this disclosure, SMS is an abbreviation for short message service. The short message service is a service often provided with the cellular services that support personal data devices. Specifically, the SMS allows for the exchange of written messages between personal data devices. The SMS is commonly referred to as text messaging. A common enhancement of SMS is the inclusion of the delivery of multimedia services. This enhanced service is often referred to as Multimedia Media Services which is abbreviated as MMS.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Vcc: As used in this disclosure, Vcc is an acronym for Voltage at the Common Collector. Technically, the Vcc is the primary power source for an NPN transistor. In this disclosure, the definition of Vcc is more broadly defined to mean a direct current voltage source.

Video: As used in this disclosure, video refers to the display of a plurality of images in a manner that simulates the perception of motion for a person viewing the video.

WiFi: As used in this disclosure, WiFi refers to the physical implementation of a collection of wireless electronic communication standards commonly referred to as IEEE 802.11x.

Wireless: As used in this disclosure, wireless is an adjective that is used to describe a communication channel between two terminals that does not require the use of physical cabling.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A safety mechanism comprising:

a bilge pump, a primary switch, a monitor switch, and a control system;

wherein the primary switch engages and disengages the operation of the bilge pump;

wherein the monitor switch mimics the operation of the primary switch;

wherein the control system simultaneously monitors the status of both the primary switch and the monitor switch;

wherein the control system generates a message to an appropriate authority;

wherein the appropriate authority is further defined with a personal data device;

wherein the personal data device receives messages from the safety system;

wherein the bilge pump is configured for use with an external power source;

wherein the external power source is a source of electrical power;

wherein the bilge pump is powered by the external power source;

wherein the bilge pump is a pump;

wherein the bilge pump removes accumulated liquid from a bilge of a watercraft;

wherein the control system monitors the status of the primary switch;

wherein the control system monitors the status of the monitor switch;

wherein the control system sends the outbound message to the appropriate authority when the operating status of the monitor switch does not mimic the operating status of the primary switch;

wherein the control system receives and processes one or more inbound messages from the appropriate authority;

wherein the control system captures a plurality of images of the bilge and sends the captured images to the appropriate authority;

wherein the control system initiates a backup protocol that provides electrical power to the bilge pump.

2. The safety mechanism according to claim 1 wherein the primary switch engages and disengages the operation of the bilge pump.

3. The safety mechanism according to claim 2 wherein the primary switch is a first float switch;

wherein the primary switch monitors the level of accumulated liquid within the bilge;

wherein the primary switch directly controls the flow of electrical energy to the bilge pump based on the level of accumulated liquid detected by the primary switch;

wherein the status of the primary switch is monitored by the control system;

wherein the primary switch is further defined with a first primary switch lead and a second primary switch lead.

4. The safety mechanism according to claim 3 wherein the first primary switch lead electrically connects to the external power source;

wherein the second primary switch lead electrically connects to the bilge pump;

wherein the control system includes a logic module that monitors the second primary switch lead.

5. The safety mechanism according to claim 4 wherein the monitor switch is a second float switch;

wherein the status of the monitor switch is monitored by the control system;

wherein the monitor switch controls the flow of electricity through the control system;

wherein the monitor switch is further defined a first monitor switch lead and a second monitor switch lead.

6. The safety mechanism according to claim 5 wherein when the monitor switch fails to mimic the primary switch, the control system generates and sends the outbound message.

7. The safety mechanism according to claim 6 wherein the first monitor switch lead electrically connects to the external power source;

wherein the logic module monitors the second monitor switch lead.

8. The safety mechanism according to claim 7 wherein the control system comprises a first communication module, a second communication module, a first camera, a second camera, a diode, an amplifier, a relay, and a pull-down resistor;

wherein the first communication module, the second communication module, the first camera, the second camera, the diode, an amplifier, the relay, and the pull-down resistor are electrically interconnected;

wherein the relay is further defined a relay switch and a relay coil.

9. The safety mechanism according to claim 8 wherein the first communication module communicates SMS and MMS messages between the safety mechanism and the appropriate authority through a first wireless communication link established with a commercially provided and publicly available cellular wireless network;

wherein the second communication module establishes a second wireless communication link between the safety mechanism and the personal data device;

wherein the first camera is an image sensor;

wherein the second camera is an image sensor;

wherein the first camera captures a first set of images of the plurality of images, the first set of images being of an area surrounding the bilge pump;

wherein the second camera captures a second set of images of the plurality of images, the second set of images being of the area surrounding the bilge pump;

wherein the field of view of the second camera is perpendicular to a field of view of the first camera;

wherein both the first camera and the second camera are capable of capturing still images and video images.

10. The safety mechanism according to claim 9 wherein the relay is an electromechanical switching device;

wherein the relay transfers electrical power from the monitor switch to the bilge pump;

wherein the relay switch is the switch contained and operated within the relay;

wherein the relay coil is an electromagnetic device;

wherein the relay coil opens and closes the relay switch.

11. The safety mechanism according to claim 10 wherein the diode isolates the bilge pump from the control system;

wherein the second monitor switch lead is the lead of the monitor switch that electrically connects to a pull-down resistor.

12. The safety mechanism according to claim 11 wherein the logic module is a programmable electronic device;

wherein the first camera transfers the first set of images as first electrical signals to the logic module;

wherein the logic module encodes the received first electrical signals and sends a first encoded image file to the appropriate authority;

wherein the second camera transfers the second set of images as second electrical signals to the logic module;

wherein the logic module which encodes the received second electrical signals and sends a second encoded image file to the appropriate authority;

wherein the relay coil receives control signals from the logic module through the amplifier;

wherein the amplifier is an electrical device that amplifies the control signal generated by the logic module to drive the relay coil;

wherein the amplifier is an electrical device that electrically buffers the logic module from the relay coil.

13. The safety mechanism according to claim 12 wherein when the relay is energized, the relay switch transfers electrical energy from the external power source through the monitor switch directly to the bilge pump.

14. The safety mechanism according to claim 13 wherein the primary switch and the monitor switch are installed directly in the bilge pump;

wherein the first camera and the second camera are installed directly in the bilge pump.

15. The safety mechanism according to claim 11 wherein the logic module is a programmable electronic device;

wherein the first camera transfers the first set of images as first electrical signals to the logic module;

wherein the logic module encodes the received first electrical signals and sends a first encoded image file to the appropriate authority;

wherein the second camera transfers the second set of images as second electrical signals to the logic module;

wherein the logic module which encodes the received second electrical signals and sends a second encoded image file to the appropriate authority;

wherein the relay coil receives control signals from the logic module through the amplifier;

wherein the amplifier is an electrical device that amplifies the control signal generated by the logic module to drive the relay coil;

wherein the amplifier is an electrical device that electrically buffers the logic module from the relay coil;

wherein the logic module makes a first decision to determine if the monitor switch mimics the primary switch;

wherein makes a second decision to determine if the primary switch is closed;

wherein the logic module takes a first action of setting a predetermined alert message to be the message sent to the appropriate authority;

wherein the logic module takes a second action of setting a predetermined alarm message to be the message sent to the appropriate authority;

wherein the logic module takes a third action of sending the selected message as an SMS message through the first communication module and the commercially provided and publicly available cellular wireless network to the personal data device of the appropriate authority;

wherein the logic module takes a fourth action using the second communication module to send the selected message directly to the personal data device of the appropriate authority using the second wireless communication link;

wherein the logic module makes a third decision to determine if the appropriate authority has sent a message to a module selected from the group consisting of the first communication module and the second communication module;

wherein the logic module takes a fourth decision to determine if the received message calls for activating the relay;

wherein the logic module takes a fifth action of sending a control signal to the relay coil through the amplifier to energize the relay;

wherein the logic module makes a fifth decision to determine if a reset has been requested;

wherein the logic module takes a sixth decision to determine whether the first communication module received the message;

wherein the logic module takes a sixth action of capturing a first image from the first camera;

wherein the logic module takes a seventh action of capturing a second image from the second camera;

wherein the logic module next takes an eighth action of sending the first encoded image file and the second encoded image file to the appropriate authority through the first communication module;

wherein the logic module takes a ninth action of capturing video from the first camera and streaming the captured video to the appropriate authority using the second communication module;

wherein the logic module then takes a tenth action of capturing video from the second camera and streaming the captured video to the appropriate authority using the second communication module.

16. The safety mechanism according to claim 15 wherein the alert message is a previously composed message that informs the appropriate authority that: 1) a fault has been detected in the safety mechanism; and, 2) the bilge pump can draw power from the external power source;

wherein the alarm message is a previously composed message that informs the appropriate authority that: 1) a fault has been detected in the safety mechanism; and, 2) the bilge pump is not able to draw power from the external power source.

17. The safety mechanism according to claim 16 wherein when the relay is energized, the relay switch transfers electrical energy from the external power source through the monitor switch directly to the bilge pump.

18. The safety mechanism according to claim 17 wherein the primary switch and the monitor switch are installed directly in the bilge pump;

wherein the first camera and the second camera are installed directly in the bilge pump.

* * * * *